United States Patent [19]

Trojani

[11] 4,306,619

[45] Dec. 22, 1981

[54] TUBE PROVIDED WITH INNER FINS AND OUTER FINS OR PINS, PARTICULARLY FOR HEAT EXCHANGERS, AND METHOD THEREFOR

[76] Inventor: Benito L. Trojani, Via Polar, 8, Lugano, Breganzona, Switzerland

[21] Appl. No.: 64,094

[22] Filed: Aug. 6, 1979

[30] Foreign Application Priority Data

Apr. 9, 1979 [IT] Italy ..... 21696 A/79

[51] Int. Cl.[3] ..... F28F 1/42

[52] U.S. Cl. ..... 165/179; 138/38; 165/182

[58] Field of Search ..... 165/179, 177, 181, 182, 165/178; 138/38, 155

[56] References Cited

U.S. PATENT DOCUMENTS

| | | | |
|---|---|---|---|
| 1,693,970 | 12/1928 | Von Platen et al. | 165/179 |
| 1,777,782 | 10/1930 | Bundy | 165/179 |
| 2,322,341 | 6/1943 | Booth | 165/179 |
| 2,386,462 | 10/1945 | Hess | 165/179 |
| 2,467,668 | 4/1949 | Hallberg | 165/179 |
| 2,703,921 | 3/1955 | Brown | 165/179 |
| 2,726,681 | 12/1955 | Gaddis et al. | 165/179 |
| 2,731,709 | 1/1956 | Gaddis et al. | 165/179 |
| 2,775,431 | 12/1956 | Krassowski | 165/182 |
| 2,930,405 | 3/1960 | Welsh | 165/179 |
| 3,002,729 | 10/1961 | Welsh | 165/179 |

*Primary Examiner*—Daniel J. O'Connor
*Attorney, Agent, or Firm*—Bucknam and Archer

[57] ABSTRACT

A tube, particularly effective as a heat exchanger, is provided with inner fins and outer fins or pins, and is made by welding to one another a plurality of sections, having a wing or rib thereof curved according to a circle arc. The sections have a T, L-shaped cross-section or a converging wing U-shaped cross-section, and the like, a substantially Z-shaped cross-section, or a wide wing beam shaped cross-section, and the like, so that they provide also the outer fins.

1 Claim, 6 Drawing Figures

TUBE PROVIDED WITH INNER FINS AND OUTER FINS OR PINS, PARTICULARLY FOR HEAT EXCHANGERS, AND METHOD THEREFOR

The present invention relates to a tube, provided with inner fins and outer fins or pins, particularly effective to be used for heat exchangers.

Also the method for making said finned tube constitutes an integral part of the present invention.

As it is known, for cooling or heating liquids and gases, in chemical and petrochemical systems, in air conditioning systems and the like, are generally used tubes which at the outer or outside surface thereof, are provided with metal pins acting to increase the thermal exchange surface.

It is also known that apparatuses exist for carrying out the pre-heating of a fluid by means of a thermal regeneration operation, carried out by causing the cool fluid to pass through tubes against which a hot fluid stream is directed in order to preserve the heat power thereof.

The object of the present invention is to provide a tube having a greater thermal exchange capacity than that of the conventional pinned or finned tubes.

The aforesaid object is advantageously achieved by the tube provided with inner fins and outer fins or pins according to the present invention.

In fact said tube, owing to the inner fins thereof, presents to the thermal exchange a surface which is greatly increased with respect to that of the conventional tubes for heat exchangers.

In particular, the tube provided with inner fins and outer fins or pins according to the invention, is formed by welding to one another a plurality of sections having an edge or preferably a rib thereof curved according to a circle arc.

The curved rib, practically, forms the tube wall, in the inside and optionally at the outside of which radially extend the wings of the sections.

These latter, substantially, may have a T, L, U-shaped cross section with converging wings and the like, thereby allowing for an innerly finned tube to be obtained.

Those same sections, furthermore, may have a substantially Z-shaped section, or a beam shaped section provided with wide wings, thus forming a tube having fins in the inside and outside surfaces.

In the case of tubes having only inner fins, the outer fins is obtained by subsequently applying, through welding, a plurality of pins, of round or elliptical cross-section, as suitably spaced and/or oriented.

It should be furthermore pointed out that the several tube lengths thus obtained are welded to one another, preferably in such a way that the fins are mutually offset.

These and other characteristics of functional and constructional nature of the tube provided with inner fins and outer pins or fins according to the present invention will become more apparent from the several figures of the accompanying drawings illustrating some preferred exemplary embodiments of the instant tube, and where:

Referring particularly to the number references of the several figures of the accompanying drawings, the tube, effective to be particularly used for heat exchangers according to the invention comprises a plurality of sections (1) having a rib or wing curved according to a circle arc.

The sections are welded at the curved portion (2) in such a way as to form the cylindric portion of the tube.

Figure 1:
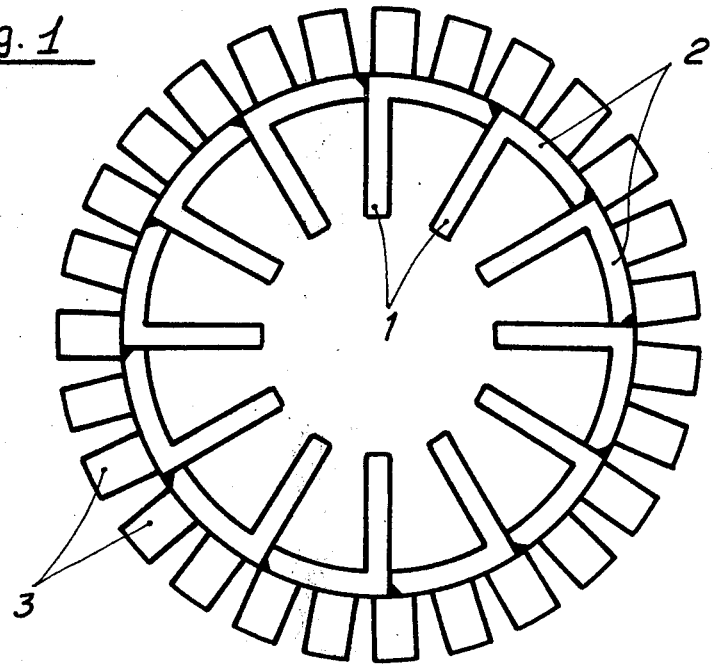
FIG. 1 shows a cross-section view of a tube obtained by using L-shaped sections.
Figure 2:
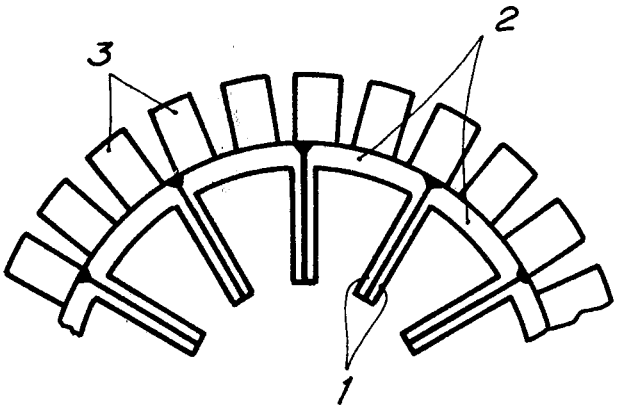
FIG. 2 illustrates a partial cross-section view of a tube as obtained by using U-shaped sections provided with converging wings.
Figure 3:
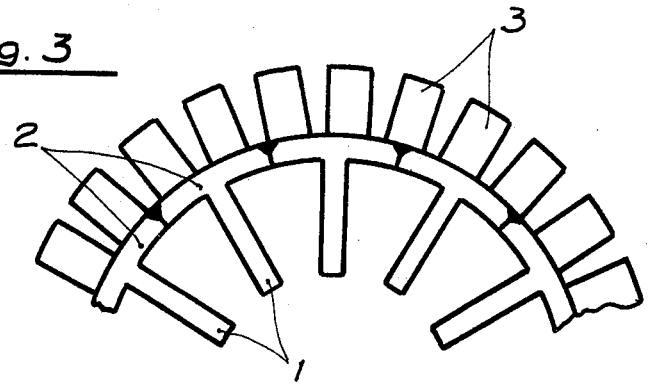
FIG. 3 illustrates a partial cross-section of a tube obtained by using T-shaped sections.

By using L-shaped sections (FIG. 1) converging wing U-shaped sections (FIG. 2), T-shaped sections (FIG. 3) and the like, is accordingly obtained a tube provided with corresponding inner radially extending fins.

In particular, in said U-shaped sections the two wings are of smaller thickness, since the wings are mutually adjoining.

On the outer surface of the thus obtained tubes are then welded a plurality of round or elliptical cross-sections pins (3) suitably arranged and/or oriented.

Figure 4:
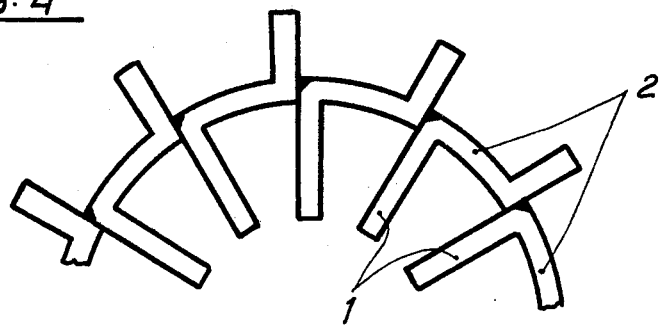
FIG. 4 illustrates a partial cross-section of a tube as obtained by using Z-shaped sections.
Figure 5:
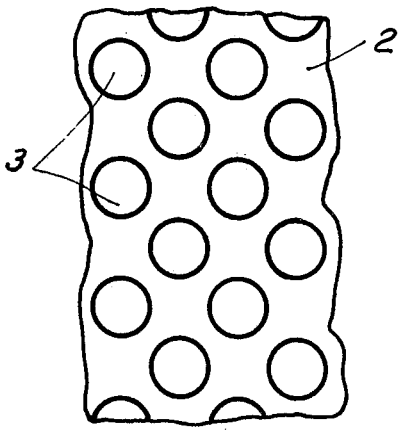
FIG. 5 illustrates a portion of a tube provided, at the outer surface, with round cross-section pins.
Figure 6:
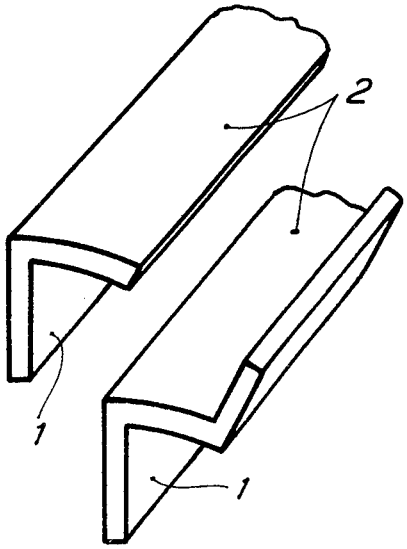
FIG. 6 illustrates, by a perspective view, portions of the aforesaid L and Z-shaped sections.

Viceversa, by using Z-shaped sections (FIG. 4), or like sections, is obtained a tube provided with radially extending inner and outer fins.

The thus obtained tube lengths, in particular, may be welded to one another, in such a way that the fins are offset from a tube length to the next one.

From the preceding description and observation of the several figures of the accompanying drawings, the greater functionaly and constructive facility characterizing the tube for heat exchangers and in particular for thermal regenerating devices provided with inner fins and outer fins or pins, according to the present invention are self evident.

Obviously the instant finned tube and related method of manufacture have been thereinabove described and illustrated only as an illustration and not limitative example and only in order to demonstrate the method and the main characteristics of the present invention.

Accordingly from the above description it may be deduced that the instant finned tube and the method of manufacture may be susceptible of several variations and modifications, according to the different needs and the practical specific use provided for the tube, being also susceptible to all improvements as suggested by the experience without departing from the scope of the invention.

I claim:

1. A heat exchanger comprising a finned tube provided with both external and internal fins, constituted by a plurality of sections, the base portion of each section being curved according to a circle arc, said sections being welded together to form the outer surface of the tube, each section being provided with at least one wing extending inwardly radially from the curved base portion to act as inner fin of the tube and with at least a fin extending outwardly radially from the curved base portion to act as external fin of the tube, wherein each section has a Z-shaped cross-section, one end portion of which constituting the inner fin, the other portion forming the outer fin, wherein the inner and the outer fin are each offset with respect to the adjacent fin, the middle portions of each section being joined to one another at the corners of said sections by a weld joint of the lower side wall of each section with the upper side wall of an adjacent section.

* * * * *